US007320954B2

(12) United States Patent
Kaneko

(10) Patent No.: US 7,320,954 B2
(45) Date of Patent: Jan. 22, 2008

(54) PENTAFLUOROBUTANE COMPOSITION AND CLEANING SOLVENT COMPOSITION

(75) Inventor: Akiyasu Kaneko, Saitama (JP)

(73) Assignee: Kaneko Chemical Co., Ltd., Saitama (JP)

( * ) Notice: Subject to any disclaimer, the term of this patent is extended or adjusted under 35 U.S.C. 154(b) by 326 days.

(21) Appl. No.: 11/064,647

(22) Filed: Feb. 24, 2005

(65) Prior Publication Data

US 2005/0233924 A1 Oct. 20, 2005

(30) Foreign Application Priority Data

Mar. 9, 2004 (JP) ..... 2004-065838

(51) Int. Cl.
*C11D 7/50* (2006.01)

(52) U.S. Cl. ..... 510/365; 510/407; 510/408; 510/410; 510/412

(58) Field of Classification Search ..... None
See application file for complete search history.

(56) References Cited

U.S. PATENT DOCUMENTS

| | | | | |
|---|---|---|---|---|
| 5,973,055 | A * | 10/1999 | Michaud et al. | 524/462 |
| 6,133,332 | A * | 10/2000 | Ide et al. | 521/131 |
| 6,403,550 | B1 * | 6/2002 | Bolmer et al. | 510/410 |
| 7,053,036 | B2 * | 5/2006 | DeGroot et al. | 510/410 |
| 7,091,170 | B2 * | 8/2006 | Kaneko | 510/407 |

FOREIGN PATENT DOCUMENTS

| | | |
|---|---|---|
| JP | 06-166894 | 6/1994 |
| JP | 06-166895 | 6/1994 |
| JP | 06-220494 | 8/1994 |
| JP | 06-322394 | 11/1994 |
| JP | 07-150196 | 6/1995 |
| JP | 07-150197 | 6/1995 |
| JP | 07-188700 | 7/1995 |
| JP | 09-302389 | 11/1997 |
| JP | 10-139697 | 5/1998 |
| JP | 11-152236 | 6/1999 |
| JP | 11-293285 | 10/1999 |
| JP | 2000-143568 | 5/2000 |
| JP | 2000-328095 | 11/2000 |
| JP | 2002-241796 | 8/2002 |
| JP | 2003-129090 | 5/2003 |
| WO | WO 01/53598 A1 | 7/2001 |

* cited by examiner

*Primary Examiner*—Gregory Webb
(74) *Attorney, Agent, or Firm*—Harness, Dickey & Pierce, PLC

(57) ABSTRACT

A pentafluorobutane composition includes, with respect to 100 parts by weight of 1,1,1,3,3-pentafluorobutane: 0.1 to 5.0 parts by weight of at least one of nitromethane and nitroethane; and 0.1 to 5.0 parts by weight of at least one of 1,3-dioxolane, trimethoxymethane, trimethoxyethane, and 1,2-butylene oxide.

20 Claims, No Drawings

PENTAFLUOROBUTANE COMPOSITION AND CLEANING SOLVENT COMPOSITION

CROSS-REFERENCE TO RELATED APPLICATIONS

The present application claims priority upon Japanese Patent Application No. 2004-65838 filed Mar. 9, 2004, the contents of which are herein incorporated by reference.

BACKGROUND OF THE INVENTION

1. Field of the Invention

The present invention relates to pentafluorobutane compositions including 1,1,1,3,3-pentafluorobutane.

2. Description of the Related Art

Chlorine-based solvents and fluorine-based solvents have been widely used as, for example, flux cleaners, solvents for dry cleaning, degreasing cleaners, buffing cleaners, resist removing agents, or solvents for removing adhesion water. Chlorine-based solvents, however, are substances causing groundwater pollution, and fluorine-based solvents are substances causing ozone layer depletion; because of their environmental problems, the use thereof is becoming restricted. From these perspectives, new solvents that could be used instead of the above-described solvents have been proposed in various fields.

1,1,1,3,3-pentafluorobutane (365 mfc, chemical formula: $C_4H_5F_5$) is one such solvent. 1,1,1,3,3-pentafluorobutane has superior characteristics in that it does not include chlorine in its molecular structure, its ozone depletion potential (ODP) is zero, it is low in toxicity, its global warming potential (GWP) is also small, and thus it is ecological and clean. Therefore, various kinds of solvents that employ 1,1,1,3,3-pentafluorobutane have been proposed. (See, for example, JP 6-322394 A, JP 7-188700 A, JP 2002-241796 A, and JP 2003-129090 A.)

1,1,1,3,3-pentafluorobutane, however, has a drawback in that, when it is used for cleaning in hostile environments such as for high-temperature cleaning or vapor degreasing, it may become unstable because of it being affected by the object to be cleaned made of metal such as iron, zinc, aluminum, copper, and brass. Therefore, proposals have been made to add some kind of stabilizer to 1,1,1,3,3-pentafluorobutane to avoid such draw backs. (See, for example, JP 6-166894 A, JP 6-166895 A, JP 2000-328095 A, and JP 11-152236 A.)

However, even when stabilizers disclosed in these references are added, there are situations where 1,1,1,3,3-pentafluorobutane cannot be sufficiently stabilized if it is recycled repetitively over a long period of time in hostile environments such as those for high-temperature cleaning, vapor degreasing, etc. The reason to this may be that hydrogen fluoride gas, which is generated due to gradual decomposition of 1,1,1,3,3-pentafluorobutane, causes negative effects, such as corrosion, with respect to the object to be cleaned such as metal. Therefore, 1,1,1,3,3-pentafluorobutane cannot be recycled repetitively over a long period of time in environments such as those for high-temperature cleaning, vapor degreasing, etc.

SUMMARY OF THE INVENTION

The present invention has been made in view of the above and other problems, and an object thereof is to provide a pentafluorobutane composition that can be used stably over a long period of time, even in environments such as those for high-temperature cleaning, vapor degreasing, etc.

An aspect of the present invention is a pentafluorobutane composition comprising, with respect to 100 parts by weight of 1,1,1,3,3-pentafluorobutane:

0.1 to 5.0 parts by weight of at least one of nitromethane and nitroethane; and 0.1 to 5.0 parts by weight of at least one of 1,3-dioxolane, trimethoxymethane, trimethoxyethane, and 1,2-butylene oxide.

Features and objects of the present invention other than the above will become clear by reading the description of the present specification.

DETAILED DESCRIPTION OF THE INVENTION

At least the following matters will be made clear through the present specification.

An aspect of the present invention is a pentafluorobutane composition comprising, with respect to 100 parts by weight of 1,1,1,3,3-pentafluorobutane:

0.1 to 5.0 parts by weight of at least one of nitromethane and nitroethane; and 0.1 to 5.0 parts by weight of at least one of 1,3-dioxolane, trimethoxymethane, trimethoxyethane, and 1,2-butylene oxide.

Such a pentafluorobutane composition can be used stably over a long period of time.

Further, the pentafluorobutane composition may include: 30 to 90 wt % of 1,1,1,3,3-pentafluorobutane; and 10 to 70 wt % of normal-propyl bromide. By including normal-propyl bromide, it is possible to provide a pentafluorobutane composition with high dissolving ability.

Further, the pentafluorobutane composition may include: 50 to 90 wt % of 1,1,1,3,3-pentafluorobutane; and 10 to 50 wt % of a propylene glycol based solvent. By including a propylene glycol based solvent, it is possible to provide a pentafluorobutane composition with high dissolving ability.

Further, the pentafluorobutane composition may include: 50 to 90 wt % of 1,1,1,3,3-pentafluorobutane; and 10 to 50 wt % of butyl alcohol. By including butyl alcohol, it is possible to provide a pentafluorobutane composition with high dissolving ability.

Further, the pentafluorobutane composition may include 0.1 to 1.0 wt % of d-limonene. By including 0.1 to 1.0 wt % of d-limonene, it is possible to reduce odor.

Further, the pentafluorobutane composition may include: 10 to 70 wt % of 1,1,1,3,3-pentafluorobutane; and 30 to 90 wt % of d-limonene and/or 3-methoxybutyl acetate. By including d-limonene and/or 3-methoxybutyl acetate, it is possible to provide a pentafluorobutane composition with high dissolving ability.

Further, the pentafluorobutane composition may include: 50 to 90 wt % of 1,1,1,3,3-pentafluorobutane; and 10 to 50 wt % of at least one of nitromethane and nitroethane, wherein the pentafluorobutane composition includes, with respect to 100 parts by weight of 1,1,1,3,3-pentafluorobutane, 0.1 to 5.0 parts by weight of at least one of 1,3-dioxolane, trimethoxymethane, trimethoxyethane, and 1,2-butylene oxide. With such a composition, it is possible to provide a pentafluorobutane composition with high dissolving ability.

Further, 0.1 to 1.0 wt % of d-limonene may be included. By including 0.1 to 1.0 wt % of d-limonene, it is possible to reduce odor.

Further, it is possible to provide a cleaning solvent composition having the above-described makeup.

===Overview of Pentafluorobutane Composition===

Embodiments of pentafluorobutane compositions according to the present invention are described below.

The pentafluorobutane composition according to the present invention includes, with respect to 100 parts by weight of 1,1,1,3,3-pentafluorobutane: 0.1 to 5.0 parts by weight of at least one of nitromethane and nitroethane; and 0.1 to 5.0 parts by weight of at least one of 1,3-dioxolane, trimethoxymethane, trimethoxyethane, and 1,2-butylene oxide.

Nitromethane and nitroethane are compounds that have been found to be effective as stabilizers through tests described below. These are important stabilizers that are necessary for keeping 1,1,1,3,3-pentafluorobutane in the pentafluorobutane composition of the present invention stable over a long period of time. It is considered that nitromethane and nitroethane prevent 1,1,1,3,3-pentafluorobutane from decomposing.

Either one of nitromethane or nitroethane or both of nitromethane and nitroethane may be included in the pentafluorobutane composition of the present invention. It should be noted that, if neither of nitromethane nor nitroethane is included, then it will not be possible to obtain a sufficient stabilizing effect and thus the pentafluorobutane composition of the present invention cannot be achieved.

The content of nitromethane and/or nitroethane is set to 0.1 to 5.0 parts by weight with respect to 100 parts by weight of 1,1,1,3,3-pentafluorobutane. This is because if the content of nitromethane and/or nitroethane is less than 0.1 parts by weight, then it is not possible to obtain a sufficient stabilizing effect because the content thereof is too small for it to function as a stabilizer, whereas if the content of nitromethane and/or nitroethane is over 5.0 parts by weight, then the amount of addition will be more than necessary because it is not possible to obtain a further stabilizing effect.

It should be noted that, other than 0.1 to 5.0 parts by weight as described above, it is also preferable to set the content of nitromethane and/or nitroethane within a range of 0.5 to 4.0 parts by weight, and more preferably, within a range of 1.0 to 3.0 parts by weight.

1,3-dioxolane, trimethoxymethane, trimethoxyethane, and 1,2-butylene oxide, similar to nitromethane and nitroethane, are also compounds that have been found to be effective as stabilizers through tests described below. These are important stabilizers that are necessary for keeping 1,1,1,3,3-pentafluorobutane of the present invention stable over a long period of time. It is considered that 1,3-dioxolane, trimethoxymethane, trimethoxyethane, and 1,2-butylene oxide function to trap the hydrogen fluoride gas ($HF_2$) that is generated due to decomposition of 1,1,1,3,3-pentafluorobutane. More specifically, nitromethane and/or nitroethane prevent 1,1,1,3,3-pentafluorobutane from decomposing, where as in case 1,1,1,3,3-pentafluorobutane decomposes, the hydrogen fluoride gas generated thereby is trapped by 1,3-dioxolane, trimethoxymethane, trimethoxyethane, or 1,2-butylene oxide.

Any one of 1,3-dioxolane, trimethoxymethane, trimethoxyethane, or 1,2-butylene oxide may be included in the pentafluorobutane composition of the present invention alone, or two or more of these may be included. Further, all of these compounds may be included in the pentafluorobutane composition of the present invention. It should be noted that, if none of 1,3-dioxolane, trimethoxymethane, trimethoxyethane, nor 1,2-butylene oxide is included, then it will not be possible to obtain a sufficient stabilizing effect and thus the pentafluorobutane composition of the present invention cannot be achieved.

The content of at least one of 1,3-dioxolane, trimethoxymethane, trimethoxyethane, and 1,2-butylene oxide is set to 0.1 to 5.0 parts by weight with respect to 100 parts by weight of 1,1,1,3,3-pentafluorobutane. This is because if the content of at least one of 1,3-dioxolane, trimethoxymethane, trimethoxyethane, and 1,2-butylene oxide is less than 0.1 parts by weight, then it is not possible to obtain a sufficient stabilizing effect because the content thereof is too small for it to function as a stabilizer, whereas if the content of at least one of 1,3-dioxolane, trimethoxymethane, trimethoxyethane, and 1,2-butylene oxide is over 5.0 parts by weight, then the amount of addition will be more than necessary because it is not possible to obtain a further stabilizing effect.

It should be noted that, although the content of 1,3-dioxolane, trimethoxymethane, trimethoxyethane, or 1,2-butylene oxide may be set to 0.1 to 5.0 parts by weight, it is preferable to set the content within a range of 0.5 to 4.0 parts by weight, and more preferably, within a range of 1.0 to 3.0 parts by weight.

Further, 1,1,1-trimethoxyethane may be used as trimethoxyethane, and also 1,1,2-trimethoxyethane may be used. Either one or both of 1,1,1-trimethoxyethane and 1,1,2-trimethoxyethane may be used.

Further, the pentafluorobutane composition of the present invention may be composed according to [1] through [4] as follows in order to improve dissolving ability.

[1] A pentafluorobutane composition may comprise: 30 to 90 wt % of 1,1,1,3,3-pentafluorobutane; and 10 to 70 wt % of normal-propyl bromide.

[2] A pentafluorobutane composition may comprise: 50 to 90 wt % of 1,1,1,3,3-pentafluorobutane; and 10 to 50 wt % of a propylene glycol based solvent.

[3] A pentafluorobutane composition may comprise: 50 to 90 wt % of 1,1,1,3,3-pentafluorobutane; and 10 to 50 wt % of butyl alcohol.

[4] A pentafluorobutane composition may comprise: 10 to 70 wt % of 1,1,1,3,3-pentafluorobutane; and 30 to 90 wt % of d-limonene and/or 3-methoxybutyl acetate.

Normal-propyl bromide described in [1] (synonym: n-propyl bromide, 1-bromopropane; referred to simply as NPB below) is a solvent that is suitable for increasing the dissolving ability of the pentafluorobutane composition of the present invention including 1,1,1,3,3-pentafluorobutane. NPB has a relatively high KB value of 125 and is superior in degreasing and cleaning. Further, similar to 1,1,1,3,3-pentafluorobutane, it is nonflammable and has incombustible or flame-resistant characteristics and is therefore not classified as a hazardous material and is safe and easy to handle. Further, NPB has superior characteristics in that it does not include chlorine or fluorine in its molecular structure, its ozone depletion potential (ODP) and its global warming potential (GWP) are also small, and thus it is ecological and clean.

The content of normal-propyl bromide is set to 10 to 70 wt %. This is because if the content of normal-propyl bromide is less than 10 wt %, then the pentafluorobutane composition of the present invention will not be able to achieve a sufficient increase in dissolving ability, whereas if the content of normal-propyl bromide is over 70 wt %, then the dissolving ability will be increased too much and this excessive increase may cause negative effects.

It should be noted that nitromethane and/or nitroethane, and 1,3-dioxolane, trimethoxymethane, trimethoxyethane, and/or 1,2-butylene oxide, which are added to 1,1,1,3,3-pentafluorobutane as stabilizers, also function effectively as stabilizers for normal-propyl bromide.

Further, similar to normal-propyl bromide, the propylene glycol based solvent described in [2] is a solvent that is suitable for increasing the dissolving ability of the pentafluorobutane composition of the present invention including 1,1,1,3,3-pentafluorobutane. The following compounds may be used as the propylene glycol based solvent in this case: propylene glycol methyl ether [PM] (boiling point: 120° C., flash point: 34° C.); dipropylene glycol methyl ether [DPM] (boiling point: 188° C., flash point: 79° C.); tripropylene glycol methyl ether [TPM] (boiling point: 242° C., flash point: 122° C.); propylene glycol n-butyl ether [PnB] (boiling point: 170° C., flash point: 62° C.); dipropylene glycol n-butyl ether [DPnB] (boiling point: 229° C., flash point: 106° C.); tripropylene glycol n-butyl ether (boiling point: 274° C., flash point: 138° C.); propylene glycol methyl ether acetate [PMA] (boiling point: 146° C., flash point: 46.5° C.); propylene glycol diacetate [PGDA] (boiling point: 190° C., flash point: 93° C.); propylene glycol phenyl ether [PPh] (boiling point: 243° C., flash point: 121° C.); and propylene glycol monoethyl ether acetate (boiling point: 158° C., flash point: 53° C.). One type of the propylene glycol based solvents listed above may be mixed alone, or several types may be mixed in combination.

The content of the propylene glycol based solvent is set to 10 to 50 wt %. This is because if the content of the propylene glycol based solvent is less than 10 wt %, then it will not be possible to achieve a sufficient increase in dissolving ability, whereas if the content of the propylene glycol based solvent is over 50 wt %, then negative effects, such as the composition becoming flammable, may arise.

Further, butyl-alcohol described in [3] ($CH_3(CH_2)_3OH$; molecular weight: 74.12; specific gravity: 0.813 (15° C.); boiling point: 117.7° C., flash point: 37° C.) is a solvent that is suitable for increasing the dissolving ability of the pentafluorobutane composition of the present invention including 1,1,1,3,3-pentafluorobutane, similar to normal-propyl bromide and the propylene glycol based solvent. The content of butyl alcohol is set to 10 to 50 wt %. This is because if the content of butyl alcohol is less than 10 wt %, then the pentafluorobutane composition of the present invention will not be able to achieve a sufficient increase in dissolving ability, whereas if the content of butyl alcohol is over 50 wt %, then negative effects, such as the composition becoming flammable, may arise.

Further, d-limonene and 3-methoxybutyl acetate described in [4] are solvents suitable for increasing the cleaning ability of 1,1,1,3,3-pentafluorobutane, similar to normal-propyl bromide, the propylene glycol based solvent, and butyl alcohol. Either one of d-limonene or 3-methoxybutyl acetate may be included alone, or both of them may be included.

It should be noted that in the pentafluorobutane composition of [1] through [4], the amount of nitromethane, nitroethane, 1,3-dioxolane, trimethoxymethane, trimethoxyethane, and 1,2-butylene oxide that is mixed is extremely small. Therefore, it is possible for the pentafluorobutane composition of [1] through [4] to include nitromethane, nitroethane, 1,3-dioxolane, trimethoxymethane, trimethoxyethane, or 1,2-butylene oxide, even if the range of the mixing amount of 1,1,1,3,3-pentafluorobutane, normal-propyl bromide, the propylene glycol based solvent, butyl alcohol, d-limonene, or 3-methoxybutyl acetate is set as described above.

The content of d-limonene and/or 3-methoxybutyl acetate is set to 30 to 90 wt %. This is because if the content of d-limonene and/or 3-methoxybutyl acetate is less than 30 wt %, then the increase in the cleaning ability will be insufficient and it will not be possible to achieve a sufficient cleaning effect, whereas if the content of d-limonene and/or 3-methoxybutyl acetate is above 90 wt %, then the characteristics of d-limonene and/or 3-methoxybutyl acetate will become too significant and it will not be possible to take full advantage of the superior features of 1,1,1,3,3-pentafluorobutane.

It should be noted that 0.1 to 1.0 wt % of d-limonene may be included in each of the compositions described in [1] through [3]. D-limonene serves as a perfume to reduce odor. That is, since normal-propyl bromide, the propylene glycol based solvent, and butyl alcohol have an extremely strong odor, d-limonene serves as to reduce the strong odor thereof.

In this case, the amount of d-limonene that is mixed is extremely small compared to the mixing amount of 1,1,1,3,3-pentafluorobutane, normal-propyl bromide, the propylene glycol based solvent, and butyl alcohol. Therefore, it is possible for the pentafluorobutane composition of [1] through [3] to include d-limonene, even if the range of the mixing amount of the solvents 1,1,1,3,3-pentafluorobutane, normal-propyl bromide, the propylene glycol based solvent, and butyl alcohol is set as described above.

Further, according to another aspect of the present invention, the pentafluorobutane composition may comprise: 50 to 90 wt % of 1,1,1,3,3-pentafluorobutane; and 10 to 50 wt % of at least one of nitromethane and nitroethane, and the pentafluorobutane composition may include, with respect to 100 parts by weight of 1,1,1,3,3-pentafluorobutane, 0.1 to 5.0 parts by weight of at least one of 1,3-dioxolane, trimethoxymethane, trimethoxyethane, and 1,2-butylene oxide.

As described above, nitromethane and nitroethane are important stabilizers that are necessary for keeping 1,1,1,3,3-pentafluorobutane stable over a long period of time. Further, nitromethane and nitroethane serve as solvents that are suitable for increasing the cleaning ability of 1,1,1,3,3-pentafluorobutane, similar to normal-propyl bromide, the propylene glycol based solvent, butyl alcohol, d-limonene, and 3-methoxybutyl acetate described above. Either one of nitromethane or nitroethane may be included in the pentafluorobutane composition of the present invention, or both of them may be included in the pentafluorobutane composition of the present invention.

The content of nitromethane and/or nitroethane is set to 10 to 50 wt %. This is because if the content of nitromethane and/or nitroethane is less than 10 wt %, then the increase in the cleaning ability will be insufficient and it will not be possible to achieve a sufficient cleaning effect, whereas if the content of nitromethane and/or nitroethane is over 50 wt %, then negative effects, such as the composition becoming flammable, may arise.

It should be noted that the amount of 1,3-dioxolane, trimethoxymethane, trimethoxyethane, and 1,2-butylene oxide that is mixed is extremely small. Therefore, it is possible for the pentafluorobutane composition to include 1,3-dioxolane, trimethoxymethane, trimethoxyethane, or 1,2-butylene oxide, even if the range of the mixing amount of 1,1,1,3,3-pentafluorobutane, nitromethane, and nitroethane is set as described above.

Further, 0.1 to 1.0 wt % of d-limonene may be included also in this case. It is possible to reduce the strong odor of nitromethane and nitroethane with d-limonene. In this case also, the amount of d-limonene that is mixed is extremely small compared to the mixing amount of 1,1,1,3,3-pentafluorobutane, nitromethane, and nitroethane. Therefore, it is possible for the pentafluorobutane composition to include d-limonene, even if the range of the mixing amount of 1,1,1,3,3-pentafluorobutane, nitromethane, and nitroethane is set as described above.

As main applications of the pentafluorobutane composition according to the present invention, it is possible to name, for example: resist removing agents, flux cleaners, degreasing cleaners for oils and fats etc., buffing cleaners, dissolution agents for adhesives (such as urethane, epoxy, and silicone), solvents for dry cleaning, removing agents for grease, oil, wax, ink etc., solvents for paint, extractants, cleaners for various articles made of glass, ceramics, rubber, metal etc. and cleaners particularly for IC parts, electrical equipments, precision equipments, optical lenses, etc., or water removing agents.

Further, when the pentafluorobutane composition of the present invention is used as a cleaning solvent, it is possible to use it in various cleaning methods such as manual wiping, immersion, spraying, ultrasonic cleaning, steam cleaning, and cleaning of nozzles of devices for filling adhesives (such as urethane, epoxy, and silicone) as well as in other general cleaning.

===Selecting Stabilizers===

Tests that were carried out for selecting the stabilizers used for the pentafluorobutane composition according to the present invention are described next.

<Test 1>

A test for studying the stability of 1,1,1,3,3-pentafluorobutane was carried out by actually mixing, as stabilizers, various kinds of compounds to 1,1,1,3,3-pentafluorobutane in order to find the stabilizers that are effective for 1,1,1,3,3-pentafluorobutane. The compounds used in this test were: nitroethane, nitromethane, 1,3-dioxolane, 1,2-butylene oxide, trimethoxymethane, 1,1,1-trimethoxyethane, 1,4-dioxane, 1,2-dimethoxyethane, acetone, methyl ethyl ketone, ethyl alcohol, isopropyl alcohol, normal-propyl alcohol, diisopropylamine, triethylamine, 2-methoxy ethanol, and ethyl acetate.

Test liquids "A1" through "A17" were prepared by respectively mixing 3 parts by weight of each of the above-mentioned compounds to 100 parts by weight of 1,1,1,3,3-pentafluorobutane, and also mixing 1 part by weight of water so as to make the state of the test liquids close to a state in which the liquids would be practically used. 30 ml of each test liquid "A1" to "A17" was filled into respective 100 ml glass test tubes. An aluminum test piece (size: 13 mm×65 mm×3 mm) was placed in each test tube in such a manner that the test piece lies in both the liquid phase and the gas phase. An air-cooled tube condenser is attached to the top of each test tube, and the test tubes were heated and refluxed in an oil bath. A pH test paper was provided in each air-cooled tube condenser. After heating and refluxing for 120 hours, the test tubes were cooled to room temperature and the test pieces were taken out from each test tube to examine the state of corrosion of the test pieces as well as the state of coloring of the test liquids. Furthermore, occurrence of generation of hydrogen fluoride gas was checked using the pH test papers attached to each air-cooled tube condenser.

Table 1 illustrates the test results. It should be noted that the state of the aluminum test piece was evaluated according to the following determination criteria: "VG (very good): no change (no corrosion)"; "G (good): slight drop in luster in some areas"; and "x (poor): drop in luster in almost the whole area". Further, the state of the test liquids was evaluated according to the following determination criteria: "VG (very good): colorless and transparent"; "G (good): slight coloring"; and "x (poor): significant coloring". Further, the occurrence of generation of hydrogen fluoride gas was evaluated according to the following criteria: "VG (very good): no generation"; and "x (poor): gas generation".

TABLE 1

Stability test for when various types of compounds are mixed

| test liquid | compound name | amount added (parts by weight) | state of test piece | state of test liquid | generation of gas |
|---|---|---|---|---|---|
| A1 | nitroethane | 3 | VG | VG | X |
| A2 | nitromethane | 3 | VG | VG | X |
| A3 | 1,3-dioxolane | 3 | G | G | X |
| A4 | 1,2-butylene oxide | 3 | X | X | X |
| A5 | trimethoxymethane | 3 | X | X | X |
| A6 | 1,1,1-trimethoxyethane | 3 | X | X | X |
| A7 | 1,4-dioxane | 3 | X | X | X |
| A8 | 1,2-dimethoxyethane | 3 | X | X | X |
| A9 | acetone | 3 | X | X | X |
| A10 | methyl ethyl ketone | 3 | X | X | X |
| A11 | ethyl alcohol | 3 | X | X | X |
| A12 | isopropyl alcohol | 3 | X | X | X |
| A13 | normal-propyl alcohol | 3 | X | X | X |
| A14 | diisopropylamine | 3 | X | X | X |
| A15 | triethylamine | 3 | X | X | X |
| A16 | 2-methoxy ethanol | 3 | X | X | X |
| A17 | ethyl acetate | 3 | X | X | X |

As shown in Table 1, it can be confirmed that as for the test liquids "A1", and "A2", in which nitroethane and nitromethane have been mixed respectively, the state of the aluminum test pieces did not change at all, and thus they are satisfactory. Further, it can be confirmed that 1,3-dioxolane has some effectiveness although it caused a slight drop in luster in some areas. It should be noted that it was found that it was not possible to prevent the generation of hydrogen fluoride gas with any of the above-mentioned compounds.

From these results, it has become clear that nitromethane and nitroethane are effective as stabilizers for 1,1,1,3,3-pentafluorobutane.

<Test 2>

Next, a test was carried out by combining, as stabilizers, various different compounds with respect to nitromethane and nitroethane, which have been confirmed in <Test 1> above as being effective. The following compounds were used in combination, as stabilizers, with respect to nitromethane and nitroethane to carry out the test: 1,3-dioxolane, 1,2-butylene oxide, trimethoxymethane, 1,1,1-trimethoxyethane, 1,4-dioxane, 1,2-dimethoxyethane, acetone, methyl ethyl ketone, ethyl alcohol, isopropyl alcohol, normal-propyl alcohol, diisopropylamine, triethylamine, 2-methoxy ethanol, and ethyl acetate.

Test liquids "B1" through "B15" were prepared by respectively mixing 3 parts by weight of nitroethane and 3 parts by weight of each of the above-mentioned compounds to 100 parts by weight of 1,1,1,3,3-pentafluorobutane, and also mixing 1 part by weight of water so as to make the state of the test liquids close to a state in which the liquids would be practically used. Further, test liquids "C1" through "C15" were prepared by respectively mixing 3 parts by weight of nitromethane and 3 parts by weight of each of the above-mentioned compounds to 100 parts by weight of 1,1,1,3,3-pentafluorobutane, and also mixing 1 part by weight of water. The same test as that described in <Test 1> was carried out using each of the test liquids "B1" through "B15" and "C1" through "C15" that have been prepared.

Table 2 illustrates the test results for the test liquids "B1" through "B15", which were prepared by using, in combination, nitroethane and each of the above-mentioned compounds. Table 3 illustrates the test results for the test liquids "C1" through "C15", which were prepared by using, in combination, nitromethane and each of the above-mentioned compounds.

TABLE 2

Stability test for when nitroethane is used combined with various types of compounds

| test liquid | compound name | amount added (parts by weight) | state of test piece | state of test liquid | generation of gas |
|---|---|---|---|---|---|
| B1 | 1,3-dioxolane | 3 | VG | VG | VG |
| B2 | 1,2-butylene oxide | 3 | VG | VG | VG |
| B3 | trimethoxymethane | 3 | VG | VG | VG |
| B4 | 1,1,1-trimethoxyethane | 3 | VG | VG | VG |
| B5 | 1,4-dioxane | 3 | VG | VG | X |
| B6 | 1,2-dimethoxyethane | 3 | VG | VG | X |
| B7 | acetone | 3 | VG | VG | X |
| B8 | methyl ethyl ketone | 3 | VG | VG | X |
| B9 | ethyl alcohol | 3 | VG | VG | X |
| B10 | isopropyl alcohol | 3 | VG | VG | X |
| B11 | normal-propyl alcohol | 3 | VG | VG | X |
| B12 | diisopropylamine | 3 | VG | VG | X |
| B13 | triethylamine | 3 | VG | VG | X |
| B14 | 2-methoxy ethanol | 3 | VG | VG | X |
| B15 | ethyl acetate | 3 | VG | VG | X |

TABLE 3

Stability test for when nitromethane is used combined with various types of compounds

| test liquid | compound name | amount added (parts by weight) | state of test piece | state of test liquid | generation of gas |
|---|---|---|---|---|---|
| C1 | 1,3-dioxolane | 3 | VG | VG | VG |
| C2 | 1,2-butylene oxide | 3 | VG | VG | VG |
| C3 | trimethoxymethane | 3 | VG | VG | VG |
| C4 | 1,1,1-trimethoxyethane | 3 | VG | VG | VG |
| C5 | 1,4-dioxane | 3 | VG | VG | X |
| C6 | 1,2-dimethoxyethane | 3 | VG | VG | X |
| C7 | acetone | 3 | VG | VG | X |
| C8 | methyl ethyl ketone | 3 | VG | VG | X |
| C9 | ethyl alcohol | 3 | VG | VG | X |

TABLE 3-continued

Stability test for when nitromethane is used combined with various types of compounds

| test liquid | compound name | amount added (parts by weight) | state of test piece | state of test liquid | generation of gas |
|---|---|---|---|---|---|
| C10 | isopropyl alcohol | 3 | VG | VG | X |
| C11 | normal-propyl alcohol | 3 | VG | VG | X |
| C12 | diisopropylamine | 3 | VG | VG | X |
| C13 | triethylamine | 3 | VG | VG | X |
| C14 | 2-methoxy ethanol | 3 | VG | VG | X |
| C15 | ethyl acetate | 3 | VG | VG | X |

As shown in Table 2, it was confirmed that generation of hydrogen fluoride gas is prevented when 1,3-dioxolane, 1,2-butylene oxide, trimethoxymethane, or 1,1,1-trimethoxyethane is mixed to nitroethane. Also, as shown in Table 3, it was confirmed that generation of hydrogen fluoride gas is prevented when 1,3-dioxolane, 1,2-butylene oxide, trimethoxymethane, or 1,1,1-trimethoxyethane is mixed to nitromethane.

From these results, it has become clear that it is preferable to mix not only nitroethane and/or nitromethane to 1,1,1,3,3-pentafluorobutane, but also mix 1,3-dioxolane, 1,2-butylene oxide, trimethoxymethane, or 1,1,1-trimethoxyethane thereto as stabilizers.

<Test 3>

Next, a test was carried out by changing the mixing ratio of either nitroethane or nitromethane, and either 1,3-dioxolane, 1,2-butylene oxide, trimethoxymethane, or 1,1,1-trimethoxyethane, with respect to 1,1,1,3,3-pentafluorobutane. Test liquids "D1" through "D24" were prepared by respectively mixing, at different mixing ratios, nitroethane and one of 1,3-dioxolane, 1,2-butylene oxide, trimethoxymethane, or 1,1,1-trimethoxyethane, with respect to 100 parts by weight of 1,1,1,3,3-pentafluorobutane, and also mixing 1 part by weight of water so as to make the state of the test liquids close to a state in which the liquids would be practically used. Further, test liquids "E1" through "E24" were prepared by respectively mixing, at different mixing ratios, nitromethane and one of 1,3-dioxolane, 1,2-butylene oxide, trimethoxymethane, or 1,1,1-trimethoxyethane, with respect to 100 parts by weight of 1,1,1,3,3-pentafluorobutane, and also mixing 1 part by weight of water. The same test as that described in <Test 1> was carried out using each of the test liquids "D1" through "D24" and "E1" through "E24" that have been prepared. Table 4 shows the mixing ratio and the test results for the test liquids "D1" through "D24". Further, Table 5 shows the mixing ratio and the test results for the test liquids "E1" through "E24".

TABLE 4

Stability test for when the mixing ratio between nitroethane and the other stabilizers is changed

| test liquid | nitro-ethane (parts by weight) | 1,3-dioxolane (parts by weight) | 1,2-butylene oxide (parts by weight) | trimethoxy-methane (parts by weight) | 1,1,1-trimethoxy-ethane (parts by weight) | state of test piece | state of test liquid | generation of gas |
|---|---|---|---|---|---|---|---|---|
| D1 | 0.1 | 0.1 | — | — | — | VG | VG | VG |
| D2 | 0.3 | 0.3 | — | — | — | VG | VG | VG |
| D3 | 0.5 | 0.5 | — | — | — | VG | VG | VG |
| D4 | 1.0 | 1.0 | — | — | — | VG | VG | VG |

TABLE 4-continued

Stability test for when the mixing ratio between nitroethane and the other stabilizers is changed

| test liquid | nitro-ethane (parts by weight) | 1,3-dioxolane (parts by weight) | 1,2-butylene oxide (parts by weight) | trimethoxy-methane (parts by weight) | 1,1,1-trimethoxy-ethane (parts by weight) | state of test piece | state of test liquid | generation of gas |
|---|---|---|---|---|---|---|---|---|
| D5 | 3.0 | 3.0 | — | — | — | VG | VG | VG |
| D6 | 5.0 | 5.0 | — | — | — | VG | VG | VG |
| D7 | 0.1 | — | 0.1 | — | — | VG | VG | VG |
| D8 | 0.3 | — | 0.3 | — | — | VG | VG | VG |
| D9 | 0.5 | — | 0.5 | — | — | VG | VG | VG |
| D10 | 1.0 | — | 1.0 | — | — | VG | VG | VG |
| D11 | 3.0 | — | 3.0 | — | — | VG | VG | VG |
| D12 | 5.0 | — | 5.0 | — | — | VG | VG | VG |
| D13 | 0.1 | — | — | 0.1 | — | VG | VG | VG |
| D14 | 0.3 | — | — | 0.3 | — | VG | VG | VG |
| D15 | 0.5 | — | — | 0.5 | — | VG | VG | VG |
| D16 | 1.0 | — | — | 1.0 | — | VG | VG | VG |
| D17 | 3.0 | — | — | 3.0 | — | VG | VG | VG |
| D18 | 5.0 | — | — | 5.0 | — | VG | VG | VG |
| D19 | 0.1 | — | — | — | 0.1 | VG | VG | VG |
| D20 | 0.3 | — | — | — | 0.3 | VG | VG | VG |
| D21 | 0.5 | — | — | — | 0.5 | VG | VG | VG |
| D22 | 1.0 | — | — | — | 1.0 | VG | VG | VG |
| D23 | 3.0 | — | — | — | 3.0 | VG | VG | VG |
| D24 | 5.0 | — | — | — | 5.0 | VG | VG | VG |

TABLE 5

Stability test for when the mixing ratio between nitromethane and the other stabilizers is changed

| test liquid | nitro-ethane (parts by weight) | 1,3-dioxolane (parts by weight) | 1,2-butylene oxide (parts by weight) | trimethoxy-methane (parts by weight) | 1,1,1-trimethoxy-ethane (parts by weight) | state of test piece | state of test liquid | generation of gas |
|---|---|---|---|---|---|---|---|---|
| E1 | 0.1 | 0.1 | — | — | — | VG | VG | VG |
| E2 | 0.3 | 0.3 | — | — | — | VG | VG | VG |
| E3 | 0.5 | 0.5 | — | — | — | VG | VG | VG |
| E4 | 1.0 | 1.0 | — | — | — | VG | VG | VG |
| E5 | 3.0 | 3.0 | — | — | — | VG | VG | VG |
| E6 | 5.0 | 5.0 | — | — | — | VG | VG | VG |
| E7 | 0.1 | — | 0.1 | — | — | VG | VG | VG |
| E8 | 0.3 | — | 0.3 | — | — | VG | VG | VG |
| E9 | 0.5 | — | 0.5 | — | — | VG | VG | VG |
| E10 | 1.0 | — | 1.0 | — | — | VG | VG | VG |
| E11 | 3.0 | — | 3.0 | — | — | VG | VG | VG |
| E12 | 5.0 | — | 5.0 | — | — | VG | VG | VG |
| E13 | 0.1 | — | — | 0.1 | — | VG | VG | VG |
| E14 | 0.3 | — | — | 0.3 | — | VG | VG | VG |
| E15 | 0.5 | — | — | 0.5 | — | VG | VG | VG |
| E16 | 1.0 | — | — | 1.0 | — | VG | VG | VG |
| E17 | 3.0 | — | — | 3.0 | — | VG | VG | VG |
| E18 | 5.0 | — | — | 5.0 | — | VG | VG | VG |
| E19 | 0.1 | — | — | — | 0.1 | VG | VG | VG |
| E20 | 0.3 | — | — | — | 0.3 | VG | VG | VG |
| E21 | 0.5 | — | — | — | 0.5 | VG | VG | VG |
| E22 | 1.0 | — | — | — | 1.0 | VG | VG | VG |
| E23 | 3.0 | — | — | — | 3.0 | VG | VG | VG |
| E24 | 5.0 | — | — | — | 5.0 | VG | VG | VG |

From Table 4 and Table 5, it can be confirmed that a sufficient stability can be obtained in a range where 0.1 to 5.0 parts by weight of either nitroethane or nitromethane and 0.1 to 5.0 parts by weight of one of 1,3-dioxolane, 1,2-butylene oxide, trimethoxymethane, or 1,1,1-trimethoxyethane are mixed with respect to 100 parts by weight of 1,1,1,3,3-pentafluorobutane.

===Dissolving Ability Test===

Next, tests for examining the dissolving ability were carried out by further mixing, to the pentafluorobutane composition to which the above-described stabilizers have been mixed, [1] normal-propyl bromide, [2] a propylene glycol based solvent, [3] butyl alcohol, and [4] d-limonene and/or 3-methoxybutyl acetate.

<Machine Oil Cleaning Test>

In this test, test pieces made of SUS-304 (length 25 mm×width 30 mm×thickness 2 mm) were prepared, and, after immersing these test pieces into machine oil (CQ-30: made by Nippon Oil Co., Ltd.), each was immersed into respective test liquids for approximately 3 minutes. Then, after subjecting the test pieces to a drying process, the cleaning state of the test pieces was studied. Compositions obtained by adding nitroethane and 1,2-butylene oxide, as stabilizers, to 1,1,1,3,3-pentafluorobutane (365 mfc) and further mixing thereto one of normal-propyl bromide, propylene glycol methyl ether (PM) as a propylene glycol based solvent, butyl alcohol, d-limonene, or 3-methoxybutyl acetate (3-MBA), were used as test liquids. Further, compositions with an increased amount of nitromethane or nitroethane were also prepared as test liquids. Table 6 and Table 7 below illustrate the composition of each test liquid and the results of cleaning. The cleaning results are shown in three levels: "x: low cleaning effect"; "G: good"; and "VG: very good".

TABLE 6

Machine Oil Cleaning Test 1 (365mfc, NPB, PM, butyl alcohol)

| | 365mfc (wt %) | NPB (wt %) | PM (wt %) | butyl alcohol (wt %) | test result |
|---|---|---|---|---|---|
| F1 | 100 | 0 | — | — | X |
| F2 | 90 | 10 | — | — | G |
| F3 | 85 | 15 | — | — | G |
| F4 | 80 | 20 | — | — | G |
| F5 | 75 | 25 | — | — | G |
| F6 | 70 | 30 | — | — | VG |
| F7 | 65 | 35 | — | — | VG |
| F8 | 60 | 40 | — | — | VG |
| F9 | 50 | 50 | — | — | VG |
| F10 | 40 | 60 | — | — | VG |
| F11 | 95 | — | 5 | — | X |
| F12 | 90 | — | 10 | — | G |
| F13 | 85 | — | 15 | — | G |
| F14 | 80 | — | 20 | — | G |
| F15 | 75 | — | 25 | — | G |
| F16 | 70 | — | 30 | — | G |
| F17 | 60 | — | 40 | — | VG |
| F18 | 50 | — | 50 | — | VG |
| F19 | 95 | — | — | 5 | X |
| F20 | 90 | — | — | 10 | G |
| F21 | 85 | — | — | 15 | G |
| F22 | 80 | — | — | 20 | G |
| F23 | 75 | — | — | 25 | G |
| F24 | 70 | — | — | 30 | G |
| F25 | 60 | — | — | 40 | VG |
| F26 | 50 | — | — | 50 | VG |

VG: very good
G: good
X: low cleaning effect
365mfc: 1,1,1,3,3-pentafluorobutane ($C_4H_5F_5$)
NPB: normal-propyl bromide
PM: propylene glycol methyl ether

TABLE 7

Machine Oil Cleaning Test 2 (365mfc, nitroethane, nitromethane, d-limonene, 3-MBA)

| | 365mfc (wt %) | nitro-ethane (wt %) | nitro-methane (wt %) | d-limonene (wt %) | 3-MBA (wt %) | cleaning result |
|---|---|---|---|---|---|---|
| G1 | 95 | 5 | — | — | — | X |
| G2 | 90 | 10 | — | — | — | G |
| G3 | 80 | 20 | — | — | — | G |

TABLE 7-continued

Machine Oil Cleaning Test 2 (365mfc, nitroethane, nitromethane, d-limonene, 3-MBA)

| | 365mfc (wt %) | nitro-ethane (wt %) | nitro-methane (wt %) | d-limonene (wt %) | 3-MBA (wt %) | cleaning result |
|---|---|---|---|---|---|---|
| G4 | 70 | 30 | — | — | — | VG |
| G5 | 60 | 40 | — | — | — | VG |
| G6 | 50 | 50 | — | — | — | VG |
| G7 | 95 | — | 5 | — | — | X |
| G8 | 90 | — | 10 | — | — | G |
| G9 | 80 | — | 20 | — | — | G |
| G10 | 70 | — | 30 | — | — | VG |
| G11 | 60 | — | 40 | — | — | VG |
| G12 | 50 | — | 50 | — | — | VG |
| G13 | 80 | — | — | 20 | — | X |
| G14 | 75 | — | — | 25 | — | X |
| G15 | 70 | — | — | 30 | — | G |
| G16 | 65 | — | — | 35 | — | G |
| G17 | 60 | — | — | 40 | — | VG |
| G18 | 50 | — | — | 50 | — | VG |
| G19 | 80 | — | — | — | 20 | X |
| G20 | 75 | — | — | — | 25 | X |
| G21 | 70 | — | — | — | 30 | G |
| G22 | 65 | — | — | — | 35 | G |
| G23 | 60 | — | — | — | 40 | VG |
| G24 | 50 | — | — | — | 50 | VG |

VG: very good
G: good
X: low cleaning effect
365mfc: 1,1,1,3,3-pentafluorobutane ($C_4H_5F_5$)
3-MBA: 3-methoxybutyl acetate From the test results shown in Table 6 and Table 7, it was found that, in order to achieve a sufficient cleaning ability, it is necessary to mix, with respect to 1,1,1,3,3-pentafluorobutane (365 mfc), 10 wt % or more of normal-propyl bromide, propylene glycol methyl ether (PM), butyl alcohol, nitromethane, or nitroethane, or 30 wt % or more of d-limonene or 3-methoxybutyl acetate (3-MBA).

<Flux Cleaning Test>

In this test, flux (TAMURA F-AL-4 made by TAMURA Corporation) was applied to the whole surface of printed wiring boards for testing, and, after subjecting them to a burning process in an electric furnace at approximately 200° C. for approximately 2 minutes, each was immersed into respective test liquids for approximately 3 minutes. Then, after subjecting the printed wiring boards to a drying process, the cleaning state was examined. Compositions obtained by adding nitroethane and 1,2-butylene oxide, as stabilizers, to 1,1,1,3,3-pentafluorobutane (365 mfc) and further mixing thereto one of normal-propyl bromide, propylene glycol methyl ether (PM) as a propylene glycol based solvent, butyl alcohol, d-limonene, or 3-methoxybutyl acetate (3-MBA), were used as cleaning liquids. Further, compositions with an increased amount of nitromethane or nitroethane were also prepared as test liquids. Table 8 and Table 9 illustrate the composition of each test liquid and the results of cleaning. The cleaning results are shown in three levels: "x: low cleaning effect"; "G: good"; and "VG: very good".

TABLE 8

Flux Cleaning Test 1 (365mfc, NPB, PM, butyl alcohol)

| | 365mfc (wt %) | NPB (wt %) | PM (wt %) | butyl alcohol (wt %) | test result |
|---|---|---|---|---|---|
| H1 | 100 | 0 | — | — | X |
| H2 | 90 | 10 | — | — | X |
| H3 | 80 | 20 | — | — | X |
| H4 | 70 | 30 | — | — | G |
| H5 | 65 | 35 | — | — | G |
| H6 | 60 | 40 | — | — | VG |
| H7 | 55 | 45 | — | — | VG |
| H8 | 50 | 50 | — | — | VG |
| H9 | 40 | 60 | — | — | VG |
| H10 | 30 | 70 | — | — | VG |
| H11 | 90 | — | 10 | — | X |
| H12 | 80 | — | 20 | — | X |
| H13 | 75 | — | 25 | — | G |
| H14 | 70 | — | 30 | — | G |
| H15 | 60 | — | 40 | — | VG |
| H16 | 55 | — | 45 | — | VG |
| H17 | 50 | — | 50 | — | VG |
| H18 | 40 | — | 60 | — | VG |
| H19 | 30 | — | 70 | — | VG |
| H20 | 90 | — | — | 10 | X |
| H21 | 80 | — | — | 20 | X |
| H22 | 75 | — | — | 25 | G |
| H23 | 70 | — | — | 30 | G |
| H24 | 60 | — | — | 40 | VG |
| H25 | 55 | — | — | 45 | VG |
| H26 | 50 | — | — | 50 | VG |
| H27 | 40 | — | — | 60 | VG |
| H28 | 30 | — | — | 70 | VG |

VG: very good
G: good
X: low cleaning effect
365mfc: 1,1,1,3,3-pentafluorobutane ($C_4H_5F_5$)
NPB: normal-propyl bromide
PM: propylene glycol methyl ether

TABLE 9

Flux Cleaning Test 2 (365mfc, nitroethane, nitromethane, d-limonene, 3-MBA)

| | 365mfc (wt %) | nitro-ethane (wt %) | nitro-methane (wt %) | d-limonene (wt %) | 3-MBA (wt %) | cleaning result |
|---|---|---|---|---|---|---|
| I1 | 95 | 5 | — | — | — | X |
| I2 | 90 | 10 | — | — | — | X |
| I3 | 80 | 20 | — | — | — | G |
| I4 | 60 | 40 | — | — | — | G |
| I5 | 50 | 50 | — | — | — | VG |
| I6 | 40 | 60 | — | — | — | VG |
| I7 | 30 | 70 | — | — | — | VG |
| I8 | 20 | 80 | — | — | — | VG |
| I9 | 95 | — | 5 | — | — | X |
| I10 | 90 | — | 10 | — | — | X |
| I11 | 80 | — | 20 | — | — | G |
| I12 | 60 | — | 40 | — | — | G |

TABLE 9-continued

Flux Cleaning Test 2 (365mfc, nitroethane, nitromethane, d-limonene, 3-MBA)

| | 365mfc (wt %) | nitro-ethane (wt %) | nitro-methane (wt %) | d-limonene (wt %) | 3-MBA (wt %) | cleaning result |
|---|---|---|---|---|---|---|
| I13 | 50 | — | 50 | — | — | VG |
| I14 | 40 | — | 60 | — | — | VG |
| I15 | 30 | — | 70 | — | — | VG |
| I16 | 20 | — | 80 | — | — | VG |
| I17 | 80 | — | — | 20 | — | X |
| I18 | 70 | — | — | 30 | — | X |
| I19 | 65 | — | — | 35 | — | X |
| I20 | 60 | — | — | 40 | — | G |
| I21 | 50 | — | — | 50 | — | G |
| I22 | 40 | — | — | 60 | — | VG |
| I23 | 30 | — | — | 70 | — | VG |
| I24 | 20 | — | — | 80 | — | VG |
| I25 | 10 | — | — | 90 | — | VG |
| I26 | 5 | — | — | 95 | — | VG |
| I27 | 80 | — | — | — | 20 | X |
| I28 | 70 | — | — | — | 30 | X |
| I29 | 65 | — | — | — | 35 | X |
| I30 | 60 | — | — | — | 40 | G |
| I31 | 50 | — | — | — | 50 | G |
| I32 | 40 | — | — | — | 60 | VG |
| I33 | 30 | — | — | — | 70 | VG |
| I34 | 20 | — | — | — | 80 | VG |
| I35 | 10 | — | — | — | 90 | VG |

VG: very good
G: good
X: low cleaning effect
365mfc: 1,1,1,3,3-pentafluorobutane ($C_4H_5F_5$)
3-MBA: 3-methoxybutyl acetate From the test results shown in Table 8 and Table 9, it was found that, in order to achieve a sufficient cleaning ability, it is necessary to mix, with respect to 1,1,1,3,3-pentafluorobutane (365 mfc), 30 wt % or more of normal-propyl bromide, 25 wt % or more of propylene glycol methyl ether (PM) or butyl alcohol, 20 wt % or more of nitromethane or nitroethane, or 40 wt % or more of d-limonene or 3-methoxybutyl acetate (3-MBA).

<Flammability Test>

Propylene glycol methyl ether (PM), butyl alcohol, nitromethane, nitroethane, d-limonene, and 3-methoxybutyl acetate (3-MBA) are flammable and combustible solvents. In view of this, a test was carried out to study the relationship between flammability and the content of these solvents when they are added to 1,1,1,3,3-pentafluorobutane (365 mfc). The test results are shown in Table 10. It should be noted that the flammability was studied according to the Tag closed cup method. Normal-propyl bromide was not tested, because it is nonflammable.

TABLE 10 flammability test (365mfc, PM, butyl alcohol, nitroethane, nitromethane, d-limonene, 3-MBA)

| | 365mfc (wt %) | PM (wt %) | butyl alcohol (wt %) | nitro-ethane (wt %) | nitro-methane (wt %) | d-limonene (wt %) | 3-MBA (wt %) | flamma-bility |
|---|---|---|---|---|---|---|---|---|
| J1 | 70 | 30 | — | — | — | — | — | none |
| J2 | 60 | 40 | — | — | — | — | — | none |

TABLE 10-continued

| | flammability test (365mfc, PM, butyl alcohol, nitroethane, nitromethane, d-limonene, 3-MBA) | | | | | | | |
|---|---|---|---|---|---|---|---|---|
| | 365mfc (wt %) | PM (wt %) | butyl alcohol (wt %) | nitro-ethane (wt %) | nitro-methane (wt %) | d-limonene (wt %) | 3-MBA (wt %) | flamma-bility |
| J3 | 50 | 50 | — | — | — | — | — | none |
| J4 | 40 | 60 | — | — | — | — | — | yes |
| J5 | 30 | 70 | — | — | — | — | — | yes |
| J6 | 20 | 80 | — | — | — | — | — | yes |
| J7 | 10 | 90 | — | — | — | — | — | yes |
| J8 | 70 | — | 30 | — | — | — | — | none |
| J9 | 60 | — | 40 | — | — | — | — | none |
| J10 | 50 | — | 50 | — | — | — | — | none |
| J11 | 40 | — | 60 | — | — | — | — | yes |
| J12 | 30 | — | 70 | — | — | — | — | yes |
| J13 | 20 | — | 80 | — | — | — | — | yes |
| J14 | 10 | — | 90 | — | — | — | — | yes |
| J15 | 70 | — | — | 30 | — | — | — | none |
| J16 | 60 | — | — | 40 | — | — | — | none |
| J17 | 50 | — | — | 50 | — | — | — | none |
| J18 | 40 | — | — | 60 | — | — | — | yes |
| J19 | 30 | — | — | 70 | — | — | — | yes |
| J20 | 20 | — | — | 80 | — | — | — | yes |
| J21 | 10 | — | — | 90 | — | — | — | yes |
| J22 | 70 | — | — | — | 30 | — | — | none |
| J23 | 60 | — | — | — | 40 | — | — | none |
| J24 | 50 | — | — | — | 50 | — | — | none |
| J25 | 40 | — | — | — | 60 | — | — | yes |
| J26 | 30 | — | — | — | 70 | — | — | yes |
| J27 | 20 | — | — | — | 80 | — | — | yes |
| J28 | 10 | — | — | — | 90 | — | — | yes |
| J29 | 70 | — | — | — | — | 30 | — | none |
| J30 | 60 | — | — | — | — | 40 | — | none |
| J31 | 50 | — | — | — | — | 50 | — | none |
| J32 | 40 | — | — | — | — | 60 | — | none |
| J33 | 30 | — | — | — | — | 70 | — | none |
| J34 | 20 | — | — | — | — | 80 | — | none |
| J35 | 10 | — | — | — | — | 90 | — | none |
| J36 | 5 | — | — | — | — | 95 | — | yes |
| J37 | 70 | — | — | — | — | — | 30 | none |
| J38 | 60 | — | — | — | — | — | 40 | none |
| J39 | 50 | — | — | — | — | — | 50 | none |
| J40 | 40 | — | — | — | — | — | 60 | none |
| J41 | 30 | — | — | — | — | — | 70 | none |
| J42 | 20 | — | — | — | — | — | 80 | none |
| J43 | 10 | — | — | — | — | — | 90 | none |
| J44 | 5 | — | — | — | — | — | 95 | yes |

365mfc: 1,1,1,3,3-pentafluorobutane ($C_4H_5F_5$)
PM: propylene glycol methyl ether
3-MBA: 3-methoxybutyl acetate From the test results shown in Table 10, it was found that, in order to make the composition nonflammable, it is necessary to keep the content, with respect to 1,1,1,3,3-pentafluorobutane (365 mfc), of propylene glycol methyl ether (PM), butyl alcohol, nitromethane, and nitroethane equal to or below 50 wt %, respectively, and keep the content, with respect to 1,1,1,3,3-pentafluorobutane (365 mfc), of d-limonene and 3-methoxybutyl acetate (3-MBA) equal to or below 90 wt %.

Although the preferred embodiment of the present invention has been described in detail, it should be understood that various changes, substitutions and alterations can be made therein without departing from spirit and scope of the inventions as defined by the appended claims.

What is claimed is:

1. A pentafluorobutane composition comprising:

100 parts by weight of 1,1,1,3,3-pentafluorobutane;

0.1 to 5.0 parts by weight of at least one of nitromethane and nitroethane; and 0.1 to 5.0 parts by weight of at least one of 1,3-dioxolane, trimethoxymethane, trimethoxyethane, and 1,2-butylene oxide.

2. A pentafluorobutane composition according to claim 1, comprising:

30 to 90 wt % of 1,1,1,3,3-pentafluorobutane;

10 to 70 wt % of normal-propyl bromide; and wherein the total percentage by weight of the constituents of said pentafluorobutane composition amounts to 100 wt %.

3. A pentafluorobutane composition according to claim 1, comprising:

50 to 90 wt % of 1,1,1,3,3-pentafluorobutane;

10 to 50 wt % of a propylene glycol based solvent; and wherein the total percentage by weight of the constituents of said pentafluorobutane composition amounts to 100 wt %.

4. A pentafluorobutane composition according to claim 1, comprising:

50 to 90 wt % of 1,1,1,3,3-pentafluorobutane;

10 to 50 wt % of butyl alcohol; and wherein the total percentage by weight of the constituents of said pentafluorobutane composition amounts to 100 wt %.

5. A pentafluorobutane composition according to claim 2, further comprising:

0.1 to 1.0 wt % of d-limonene, wherein the total percentage by weight of the constituents of said pentafluorobutane composition amounts to 100 wt %.

6. A pentafluorobutane composition according to claim 3, further comprising:

0.1 to 1.0 wt % of d-limonene, wherein the total percentage by weight of the constituents of said pentafluorobutane composition amounts to 100 wt %.

7. A pentafluorobutane composition according to claim 4, further comprising:

0.1 to 1.0 wt % of d-limonene, wherein the total percentage by weight of the constituents of said pentafluorobutane composition amounts to 100 wt %.

8. A pentafluorobutane composition according to claim 1, comprising:

10 to 70 wt % of 1,1,1,3,3-pentafluorobutane;

30 to 90 wt % of d-limonene and/or 3-methoxybutyl acetate; and wherein the total percentage by weight of the constituents of said pentafluorobutane composition amounts to 100 wt %.

9. A pentafluorobutane composition comprising:

50 to 90 wt % of 1,1,1,3,3-pentafluorobutane;

10 to 50 wt % of at least one of nitromethane and nitroethane;

wherein said pentafluorobutane composition includes, with respect to 100 parts by weight of 1,1,1,3,3-pentafluorobutane, 0.1 to 5.0 parts by weight of at least one of 1,3-dioxolane, trimethoxymethane, trimethoxyethane, and 1,2-butylene oxide; and wherein the total percentage by weight of the constituents of said pentafluorobutane composition amounts to 100 wt %.

10. A pentafluorobutane composition according to claim 9, further comprising:

0.1 to 1.0 wt % of d-limonene, wherein the total percentage by weight of the constituents of said pentafluorobutane composition amounts to 100 wt %.

11. A cleaning solvent composition comprising:

100 parts by weight of 1,1,1,3,3-pentafluorobutane;

0.1 to 5.0 parts by weight of at least one of nitromethane and nitroethane; and 0.1 to 5.0 parts by weight of at least one of 1,3-dioxolane, trimethoxymethane, trimethoxyethane, and 1,2-butylene oxide.

12. A cleaning solvent composition according to claim 11, comprising:

30 to 90 wt % of 1,1,1,3,3-pentafluorobutane;

10 to 70 wt % of normal-propyl bromide; and wherein the total percentage by weight of the constituents of said cleaning solvent composition amounts to 100 wt %.

13. A cleaning solvent composition according to claim 11, comprising:

50 to 90 wt % of 1,1,1,3,3-pentafluorobutane;

10 to 50 wt % of a propylene glycol based solvent; and wherein the total percentage by weight of the constituents of said cleaning solvent composition amounts to 100 wt %.

14. A cleaning solvent composition according to claim 11, comprising:

50 to 90 wt % of 1,1,1,3,3-pentafluorobutane;

10 to 50 wt % of butyl alcohol; and wherein the total percentage by weight of the constituents of said cleaning solvent composition amounts to 100 wt %.

15. A cleaning solvent composition according to claim 12, further comprising:

0.1 to 1.0 wt % of d-limonene, wherein the total percentage by weight of the constituents of said cleaning solvent composition amounts to 100 wt %.

16. A cleaning solvent composition according to claim 13, further comprising:

0.1 to 1.0 wt % of d-limonene, wherein the total percentage by weight of the constituents of said cleaning solvent composition amounts to 100 wt %.

17. A cleaning solvent composition according to claim 14, further comprising:

0.1 to 1.0 wt % of d-limonene, wherein the total percentage by weight of the constituents of said cleaning solvent composition amounts to 100 wt %.

18. A cleaning solvent composition according to claim 11, comprising:

10 to 70 wt % of 1,1,1,3,3-pentafluorobutane;

30 to 90 wt % of d-limonene and/or 3-methoxybutyl acetate; and wherein the total percentage by weight of the constituents of said cleaning solvent composition amounts to 100 wt %.

19. A cleaning solvent composition comprising:

50 to 90 wt % of 1,1,1,3,3-pentafluorobutane;

10 to 50 wt % of at least one of nitromethane and nitroethane, wherein said pentafluorobutane composition includes, with respect to 100 parts by weight of 1,1,1,3,3-pentafluorobutane, 0.1 to 5.0 parts by weight of at least one of 1,3-dioxolane, trimethoxymethane, trimethoxyethane, and 1,2-butylene oxide; and wherein the total percentage by weight of the constituents of said cleaning solvent composition amounts to 100 wt %.

20. A cleaning solvent composition according to claim 19, further comprising:

0.1 to 1.0 wt % of d-limonene, wherein the total percentage by weight of the constituents of said cleaning solvent composition amounts to 100 wt %.

* * * * *